US006147441A

United States Patent [19]

Osamura

[11] Patent Number: 6,147,441

[45] **Date of Patent: *Nov. 14, 2000**

[54] SPARK PLUG

[75] Inventor: Hironori Osamura, Chiryu, Japan

[73] Assignee: Denso Corporation, Kariya, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/760,719

[22] Filed: Dec. 5, 1996

[30] Foreign Application Priority Data

Dec. 6, 1995 [JP] Japan ..... 7-318307
Oct. 25, 1996 [JP] Japan ..... 8-284179

[51] Int. Cl.[7] ..... H01T 13/20

[52] U.S. Cl. ..... 313/141; 313/142

[58] Field of Search ..... 313/141, 142, 313/143, 144, 136; 123/169 EL

[56] References Cited

U.S. PATENT DOCUMENTS

| | | | |
|---|---|---|---|
| 3,407,326 | 10/1968 | Romine | 313/136 |
| 4,893,051 | 1/1990 | Kondo | 313/141 |
| 5,101,135 | 3/1992 | Oshima | 313/142 |
| 5,124,612 | 6/1992 | Takamura et al. | 313/141 |
| 5,159,232 | 10/1992 | Sato et al. | 313/141 |
| 5,465,022 | 11/1995 | Katoh et al. | 313/144 |

FOREIGN PATENT DOCUMENTS

| | | |
|---|---|---|
| 62-5581 | 1/1967 | Japan . |
| 59-191281 | 10/1984 | Japan . |
| 2-49388 | 2/1990 | Japan . |
| 5-242954 | 9/1993 | Japan . |

*Primary Examiner*—Nimeshkumar D. Patel
*Assistant Examiner*—Michael J. Smith
*Attorney, Agent, or Firm*—Pillsbury Madison & Sutro LLP

[57] ABSTRACT

A spark plug with a plug screw outer diameter D of 10 mm–12 mm, wherein the length A of the discharge gap 6, the width B of the gas volume 7, the protruding length C of the insulator 2 with respect to the fitting piece 1, the diameter F of the center electrode 3, the end diameter G of the noble metal tip 51 and the protruding height H of the noble metal tip 51 with respect to the center electrode 3 are within the following ranges:

0.9 mm≦A≦1.35 mm, (10/9)A≦B, 1.0 mm≦C≦2.5 mm, 10 mm≦D≦12 mm, 2.0 mm≦F≦2.7 mm, 0.6 mm≦G≦0.9 mm, and 0.3 mm≦H≦1.0 mm.

4 Claims, 8 Drawing Sheets

SPARK PLUG

BACKGROUND OF THE INVENTION

1. Field of the Invention

The present invention relates to a small-sized, long-lasting spark plug which is suitable for use in the internal combustion engines of automobiles and the like.

2. Description of the Related Art

Spark plugs used in automobile gasoline engines have conventionally consisted of, as shown in FIG. 1, an insulator 2 which covers a center electrode 3 made of nickel alloy, a fitting piece 1 fitted around the periphery of the insulator 2, a grounding electrode 4 provided at the end of the fitting piece 1 and a noble metal tip 52 provided at the tip of the grounding electrode 4, and it is designed so that a spark current flows in the discharge gap 6 between the noble metal tip 52 and the center electrode 1, thus igniting a gas mixture compressed in a combustion chamber by the electrical discharge generated thereby.

However, when the center electrode 1 consists of a nickel alloy alone, the wear rate is exceedingly high, rendering it difficult to provide a long-lasting spark plug.

Thus, long-lasting spark plugs have been produced by welding a platinum tip 51 as a noble metal material to the discharge section of the electrode made of the nickel alloy.

Nevertheless, internal combustion engines in recent years have larger valve sizes or greater numbers of valves required for greater output and mileage, and this has reduced the amount of space available for mounting of the spark plugs, thus leading to requirements for smaller sized spark plugs. Specifically, spark plugs used in motor bicycles and compact automobiles must have plug screw diameters of about 12 mm or smaller.

In the wake of these circumstances, it has been necessary to produce small spark plugs wherein the electrodes are welded with noble metal tips made of iridium and iridium alloy materials to provide superior wear resistance.

Japanese Unexamined Patent Publication No. 2-49388 discloses a spark plug which employs a noble metal tip 51 made of Ir or Ir alloy materials, which have greater wear resistance than Pt or Pt alloys.

Here, the present inventors have attempted to form a small-sized, wear-resistant noble metal tip 51 using Ir and Ir alloy materials, which noble metal tip 51 is applied for use in small-sized spark plugs.

However, the present inventors have experimentally confirmed that long-lasting, small-sized spark plugs provided with noble metal tips 51 made of Ir or Ir alloy materials frequently generate "side sparks" which fly in the gas volume 7 between the inner wall of the fitting piece 1 and the outer wall or housing of the insulator 2 during use, and these side sparks drastically reduce the driving characteristics such as idle stability and acceleration.

Consequently, it has been an object of the present invention to elucidate the reason for frequent generation of side sparks occurring with noble metal tips made of Ir or Ir alloys, and to provide a spark plug which greatly minimizes generation of side sparks despite being a small-sized spark plug employing iridium or iridium alloys.

SUMMARY OF THE INVENTION

As a result of detailed research, the present inventors have found that the considerable generation of side sparks with iridium or iridium alloy tips is attributable to the following reasons.

Specifically, platinum, whose melting point is about 700° K lower than iridium, generates large molten and aggregated particles on the discharge surface due to the two factors of spark energy and high temperature combustible gas. Generation of these particles creates irregularities on the electrode surface. Formation of these irregularities results in greater electrolysis, to allow easier spark discharge.

Thus, the present invention provides a small-sized spark plug made of an iridium which produces almost no generation of side sparks, as a measure to counter the finding that small-sized spark plugs provided with iridium materials have a more notable phenomenon of side sparks compared to conventional platinum tips.

In other words, the present invention relates to a spark plug which comprises

- a center electrode (3) made of a Ni alloy material with a tip section (3*a*);
- an insulator (2) which covers the periphery of the center electrode (3) so that the tip section (3*a*) of the center electrode (3) is exposed, the insulator also having a tip section (2*b*);
- a fitting piece (1) which surrounds the periphery of the insulator (2) and forms a plug screw on the outer side, a gas volume (7) being formed between the fitting piece (1) and the insulator (2), and the tip section (2*b*) of the insulator (2) being exposed;
- a noble metal tip (51) made of Ir or Ir alloy material provided on the tip section (3*b*) of the center electrode (3); and
- a grounding electrode (4) anchored to the fitting piece (1) and separate from and opposite the noble metal tip (51) and discharge gap (6);

wherein $0.9\ \text{mm} \leqq A \leqq 1.35\ \text{mm}$,
$(10/9)A \leqq B$,
$1.0\ \text{mm} \leqq C \leqq 2.5\ \text{mm}$,
$10\ \text{mm} \leqq D \leqq 12\ \text{mm}$,
$2.0\ \text{mm} \leqq F \leqq 2.7\ \text{mm}$,
$0.6\ \text{mm} \leqq G \leqq 0.9\ \text{mm}$, and
$0.3\ \text{mm} \leqq H \leqq 1.0\ \text{mm}$, where A is the length of the discharge gap (6), B is the width of the gas volume (7), C is the protruding length of the insulator (2) with respect to the fitting piece (1), D is outer diameter of the plug screw section of the fitting piece (1), F is the diameter of the tip section (3*b*) of the center electrode (3), G is the diameter of the end of the noble metal tip (51), and H is the protruding height of the noble metal tip (51) with respect to the center electrode (3).

More specifically, the spark plug of the present invention is a small-sized spark plug with a plug screw outer diameter D of 12 mm or smaller, and for production-related reasons the plug screw outer diameter D is 10 mm or greater. Also, the noble metal tip (51) is formed of a high-melting-point Ir or Ir alloy material, for the purpose of improving the wear resistance of the noble metal tip (51) and to allow its long-term use despite its small size. This construction provides a spark plug according to the invention which is small-sized and long-lasting.

In addition, the amount of material used and consumed for the noble metal tip (51) is minimized since the construction is such that the insulator (2) covers the periphery of the center electrode (3) while exposing the tip section (3*a*) of the center electrode (3), with the noble metal tip (51) attached to the tip section (3*a*), while the center electrode (3) supported on the insulator (2) is formed of a Ni alloy and only the noble metal tip (51) responsible for spark discharge is formed of the highly wear-resistant Ir or Ir alloy material.

Furthermore, the spark plug which is aimed at providing a smaller size, longer life and reduced cost is also characterized by having the following dimension restrictions.

First, the present inventors found as a result of experience that when the diameter F of the center electrode (3) is smaller than 2.0 mm, the noble metal tip (51) resists allowing heat from the electric sparks and combustion gas to escape toward the center electrode (3) and thus the heat is confined to the noble metal tip (51), resulting in poor wear resistance of the noble metal tip (51). The upper limit for F is 2.7 mm. Thus, according to the present invention, 2.0 mm≦F≦2.7 mm.

The present inventors have also found as a result of experience that when the end diameter G of the noble metal tip (51) is smaller than 0.6 mm, the temperature of the noble metal tip (51) is further increased, impairing the wear resistance and rendering the spark plug unusable after a long period.

Furthermore, the present inventors have also found through experiment that since Ir and Ir alloy materials are hard and brittle, a small end diameter G renders the noble metal tip (51) more prone to damage during production, thus impairing productivity and manageability and creating practical problems. Therefore, according to the present invention the end diameter G of the noble metal tip (51) has the restriction 0.6≦G mm.

The present inventors have also found, as a result of experiment, that when the protruding height H of the noble metal tip (51) with respect to the center electrode (3) is smaller than 0.3 mm, the ignitability thereof is notably impaired. In addition, although no problems are presented in terms of flying sparks or ignitability even when H is greater than 1.0 mm, since the noble metal tip is made of hard and brittle pure iridium or iridium alloy, there are problems of poor workability and inconveniences in production handling of the noble metal tip, thus constituting an obstacle to mass production of the spark plug. Thus, according to the present invention, 0.3 mm≦H≦1.0 mm.

In the case of small-sized, long-lasting inexpensive spark plugs with dimensions in the ranges specified above, dimension ranges which effectively prevent side sparks have been experimentally determined by the present inventors and are described below.

First, as will be explained later, the present inventors have experimentally confirmed that when the end diameter G of the noble metal tip (51) is greater than 0.9 mm, there is a greater tendency toward "side sparks" which are electrical sparks flying between the center electrode (3) and fitting piece (1).

Thus, the spark plug of the present invention has the condition:

G≦0.9 mm, to allow effective prevention of side sparks.

The present inventors have also experimentally confirmed, as explained below, that when the length A of the discharge gap (6) is smaller than 0.9 mm, the ignitability is impaired.

Thus, the spark plug of the present invention has the condition:

0.9≦A mm, in order to prevent impaired ignitability.

The present inventors have also experimentally confirmed, as explained below, that when the width B (mm) of the gas volume (7) is less than (10/9)×A, there is a greater tendency for side sparks to occur.

Thus, the spark plug of the present invention has the condition:

(10/9)×A≦B to allow effective prevention of side sparks.

The present inventors have also experimentally confirmed, as explained below, that when the protruding length C of the insulator (2) with respect to the fitting piece (1) is 1.0 mm or less, there is a greater tendency for side sparks to occur.

Thus, the spark plug of the present invention has the condition:

1.0≦C mm to allow effective prevention of side sparks.

There is no particular upper limit on the protruding height, and it may be stated at least that there are no problems whatsoever up to 2.5 mm.

Also, the width B of the gas volume is limited to 1.5 mm for a housing screw diameter of 12 mm. In this case, the upper value for A is 1.35, rather than B≧(10/9)×A.

According to the invention described in claim 2, the noble metal tip (51) consists of an Ir alloy material comprising a mixture of Ir and one or more noble metals selected from Pt, Pd, Rh and Ru, and according to the invention described in claim 3, the noble metal tip (51) is characterized by consisting of an Ir alloy material comprising a mixture of one or more selected from Ni, W, Si, $Y_2O_3$ and $ZrO_2$ with Ir or the Ir alloy material according to claim 2.

The noble metal tip (51) made of such material has excellent wear resistance, and thus can help lengthen the usable life of the spark plug.

As mentioned above, the present invention is characterized by specifying not only the dimensions (A, B and C) directly related to side sparks, but also by specifying the relationship between the dimensions (G and H) which determine the tendency for sparks to fly with iridium materials, and the dimensions (A, B and C) which are directly related to side sparks.

DESCRIPTION OF THE PREFERRED EMBODIMENTS

Spark plugs according to embodiments of the invention will now be explained with reference to FIGS. 2 and 3.

Figure 1:
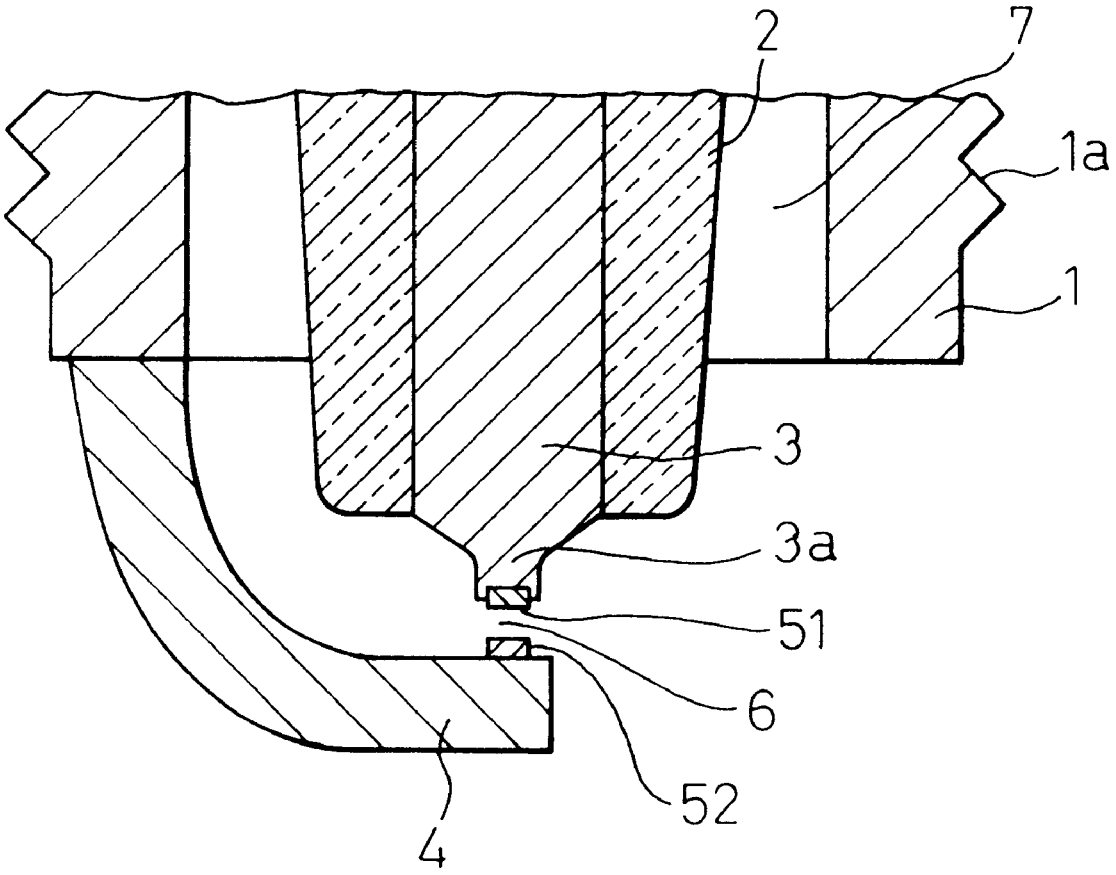
Fig. 1 PRIOR ART
FIG. 1 is a cross-sectional view of a conventional spark plug.
Figure 2:
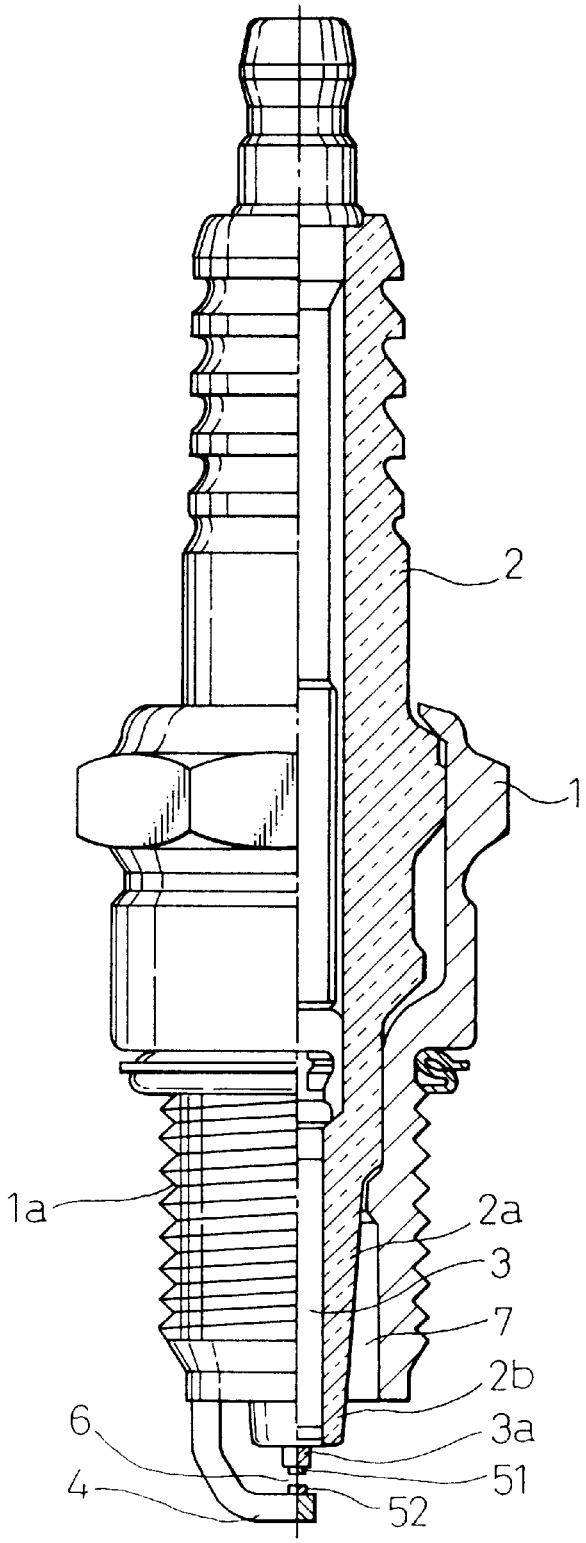
FIG. 2 is a partial cross-sectional view of a spark plug which illustrates an embodiment of the invention.

In FIG. 2, 1 is a cylindrical fitting piece made of a corrosion-resistant, conductive metal material (iron alloy), and it is provided with a fitting screw section 1*a* for mounting onto an engine block which is not shown. This embodiment of the spark plug is a small-sized spark plug with the plug screw outer diameter D of the screw section 1*a* being less than 12 mm. For production reasons, the plug screw outer diameter D is at least 10 mm.

An insulator 2 made of alumina ceramic ($Al_2O_3$) is attached inside the fitting piece 1, and a center electrode 3 is affixed to the axial opening 2*a* of the insulator 2. The tip section 2*b* of the insulator 2 is set so as to be exposed from the fitting piece 1. The center electrode 3 is a cylinder made of a highly heat conductive metal material such as Cu as the interior and a heat-resistant, corrosion-resistant, conductive metal material such as a Ni alloy as the exterior, and as shown in FIG. 3, it is constructed so that its tip section 3*a* is exposed from the tip section 2*b* of the insulator 2.

The area around the center electrode 3 at the position corresponding to the protruding end 2*c* of the insulator 2 forms a very slight minor diameter. This eliminates damage to the insulator 2 by the outer perimeter of the center electrode 3 touching the protruding end 2*c* of the insulator 2.

A grounding electrode 4 is also attached by welding to one end of the fitting piece 1. This grounding electrode 4 is made of a metal material such as Ni alloy, which is heat-resistant, corrosion-resistant and conductive, and it is separate from and opposite the tip section 3*a* of the center electrode 3 and the discharge gap 6. A noble metal tip 51 is also provided on the tip section 3*a* of the center electrode 3. Specifically, as in FIG. 3 the noble metal tip 51 is inserted into a hole 3*b* formed in the tip section 3*a* of the center electrode 3, and then the periphery of the tip section 3*a* of the center electrode 3 is caulked to anchor the noble metal tip 51 in the hole 3*b*, after which laser welding is performed to form a welded layer 8 between the center electrode 3 and the noble metal tip 51 for secure anchoring.

Figure 3:
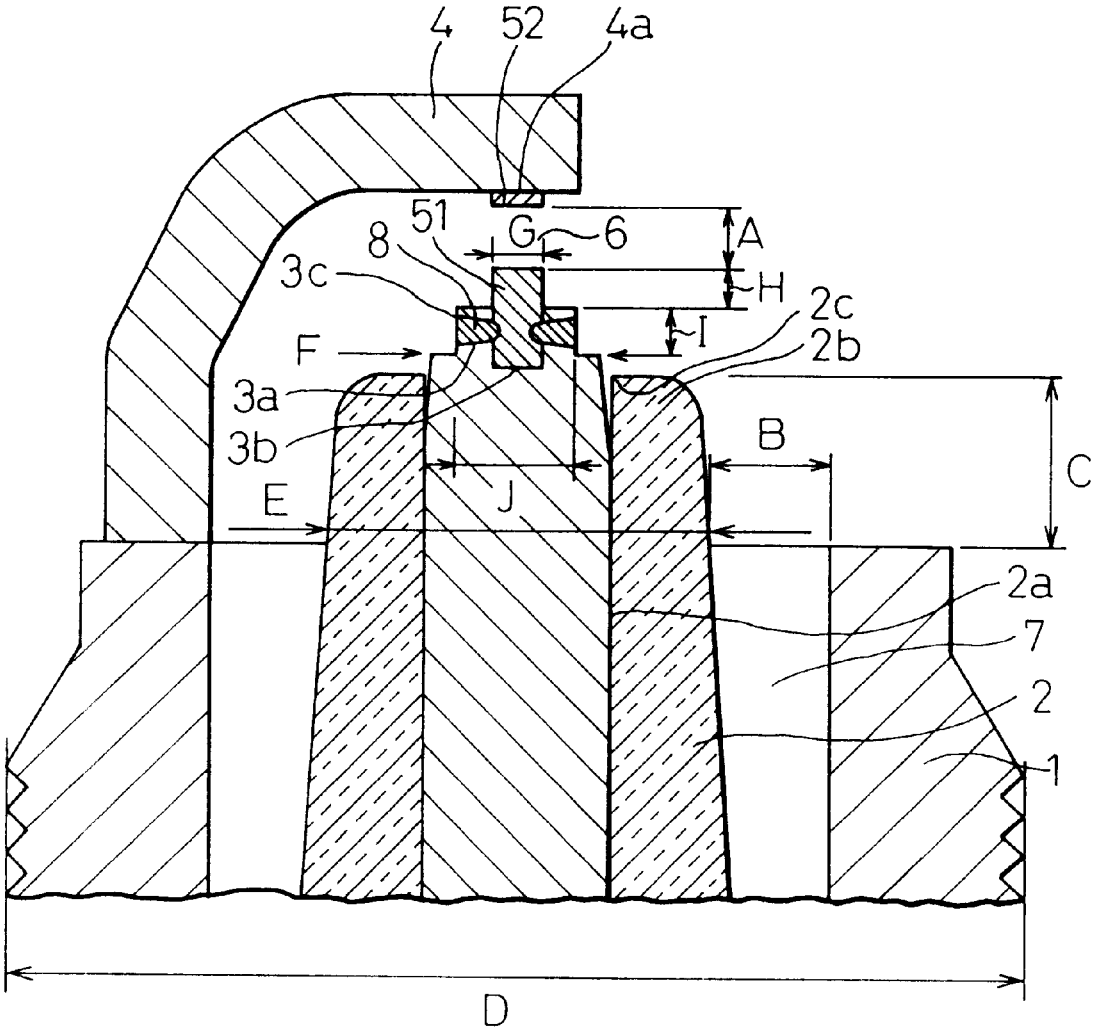
FIG. 3 is an abbreviated magnified view of FIG. 1.

Here, as shown in FIG. 3, a cylinder section 3*c* with a diameter smaller than the center section is formed at the tip section 3*a* of the center electrode 3. This allows formation of a welding layer 8 which uniformly welds together the center electrode 3 and the noble metal tip 51, since the laser light perpendicularly strikes the outer periphery of the cylinder section 3*c* during the laser welding, thus providing more secure anchoring of the noble metal tip 51 to the tip section 3*a* of the center electrode 3. In addition, another noble metal tip 52 is anchored by resistance welding to the section 4*a* of the grounding electrode 4 corresponding to the tip section 3*a* of the center electrode 3. This noble metal tip 52 thus forms part of the grounding electrode 4.

The noble metal tips 51, 52 are cylindrical, and are made of noble metal materials with heat resistance, corrosion resistance, conductivity and a high melting point. The noble metal tip 51 by which the present invention is characterized is made of a high-melting-point Ir or Ir alloy, while the noble metal tip 52 is made of a Pt alloy material, such as Pt/20 wt % Ir/2 wt % Ni (hereunder referred to as Pt-20Ir-2Ni).

Recently engines have lower engine rotation speeds during idling, and higher air-fuel ratios (air volume/fuel volume) for more efficient use of fuel. Accordingly, excellent spark plugs are those spark plugs with good ignitability even with high air-fuel ratios (low fuel concentration) during idling.

The results of evaluating the ignitability of the spark plug will now be discussed with reference to FIG. 4.

The spark plug used for this evaluation was one such as shown in FIG. 3, wherein the plug screw outer diameter D was 12 mm, the protruding height H of the noble metal tip 51 with respect to the center electrode 3 was 0.3 mm, the width B of the gas volume 7 was 1.7 mm, the protruding length C of the insulator 2 with respect to the fitting piece 1 was 2.0 mm, the tip diameter E of the insulator 2 was 4.6 mm and the diameter F of the center electrode 3 near the tip section 2*b* of the insulator 2 was 2.5 mm; the noble metal tip 51 on the center electrode 3 side was made of Ir.

The noble metal tip 52 was made of Pt-20Ir-2Ni, the tip diameter was 0.9 mm, the height was 0.3 mm, the height I of the cylinder section 3*c* of the center electrode 3 was 1.0 mm, and the diameter J was 1.5 mm. Here, the shape and material of the noble metal tip 52 and the cylinder section 3*c* of the center electrode 3 were the same as for the evaluation spark plugs described later.

Spark plugs wherein the end diameter G of the noble metal tip 51 was respectively 0.6, 0.9 and 1.2 mm, were constructed with discharge gaps A of 0.7, 0.9 and 1.1 mm, and the spark plugs were evaluated for ignitability.

Also, a conventional spark plug used for the evaluation had a plug screw outer diameter D of 12 mm, an end diameter G of 1.1 mm for the noble metal tip 51, a protruding height H of 0.4 mm for the noble metal tip 51, a discharge gap A of 1.1 mm, a gas volume 7 width B of 1.7 mm and protruding length C of 2.0 mm, an insulator 2 tip diameter E of 4.6 mm and a diameter F of 2.5 mm for the center electrode 3 near the tip section 2*b* of the insulator 2. Also, the noble metal tip 51 was formed of Pt-20Ir-2Ni, and the noble metal tip 52 was the same as the evaluation spark plugs described above.

The evaluation of the ignitability was made using a 4-cylinder, 2000 cc gasoline engine, under idling conditions (engine speed=650 rpm) requiring high ignitability. Idling was continued for 2 minutes at a constant air-fuel ratio (air volume/fuel volume), and in cases of no more than one misfire (HC spike) occurring during the 2 minutes, the air-fuel ratio was increased and the idling was continued for 2 more minutes. The evaluation was repeated to an air-fuel ratio at which at least 2 misfires occurred during 2 minutes of idling, and this air-fuel ratio was recorded as the threshold air-fuel ratio.

This evaluation for measuring the threshold air-fuel ratio was repeated 3 times for each of the spark plugs described above. A high threshold air-fuel ratio indicates that the spark plug has excellent ignitability of no more than one misfire even using gas mixtures with low fuel contents. The threshold of 2 occurrences of misfires was used because a single misfire can occur due to judgment error or pure chance, and thus it is difficult to confirm that one misfire has definitely occurred during 2 minutes of continuous idling.

Figure 4:
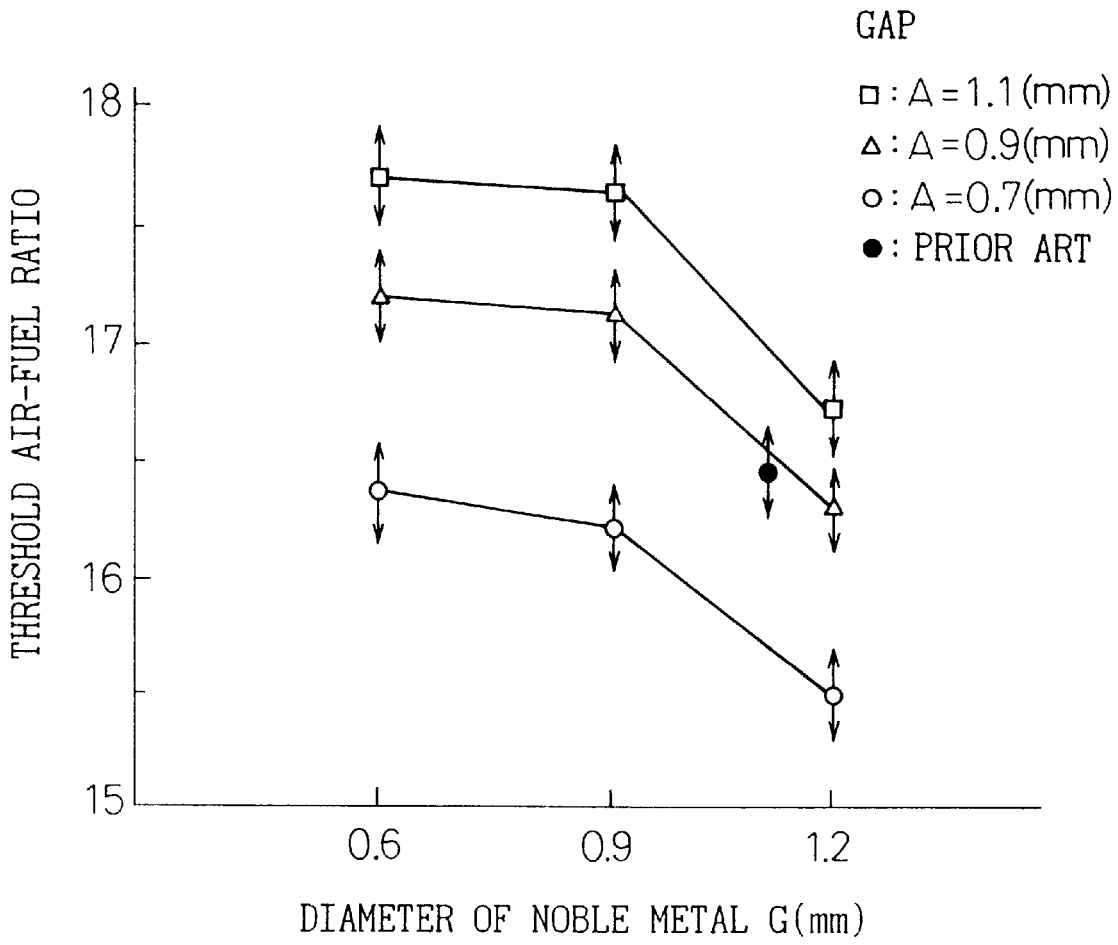
FIG. 4 is a graph showing the evaluation of ignitability.

As the results in FIG. 4 show, when the end diameter G of the noble metal tip 51 is 0.9 mm or less and the discharge gap A (mm) is 0.9 mm or greater, the threshold air-fuel ratio becomes much higher compared to a conventional spark plug. In other words, it was confirmed that when $G \leqq 0.9$ mm and $0.9 \leqq A$ in this embodiment, the ignitability is improved over conventional spark plugs.

The results of evaluating the tendency toward side sparks in the spark plug will now be discussed with reference to FIGS. 5A–5C.

The spark plug used for this evaluation was one such as shown in FIG. 3, wherein the plug screw outer diameter D was 12 mm, the protruding height H of the noble metal tip 51 with respect to the center electrode 3 was 0.8 mm, the end diameter G was 0.9 mm, the tip diameter E of the insulator 2 was 4.6 mm and the diameter F of the center electrode 3 near the tip section 2*b* of the insulator 2 was 2.5 mm. Also, in the case of a spark plug with a protruding length C of 0.0 mm, the tendency toward side sparks was evaluated for gas volume 7 widths B of 1.0, 1.25 and 1.5 mm, and A/B ratios of 0.8, 0.9, 1.0 and 1.1. The same evaluation was made for spark plugs with protruding lengths C of 1.0 and 2.0.

Here, the gas volume 7 width B was varied to 1.0, 1.25 and 1.5 by changing the thickness of the fitting piece 1. The ratio of A/B was varied to 0.8, 0.9, 1.0 and 1.1 by moving the grounding electrode 4 against a constant gas volume 7 width B to change the discharge gap A. The noble metal tip 51 was made of Ir, and the cylinder section of the tip of the noble metal tip 51 was cut round to a curvature radius R of 0.3 mm, to simulate wearing of the noble metal tip 51.

The evaluation of the tendency for side sparks was conducted using a 4-cylinder, 2000 cc gasoline engine, opening the throttle under conditions most conducive to occurrence of side sparks, i.e. under idling conditions (engine speed=650 rpm), and then immediately racing the engine to its maximum speed (engine speed=about 6000 rpm) a total of 50 times and counting the number of side sparks which occurred.

Figure 6A:
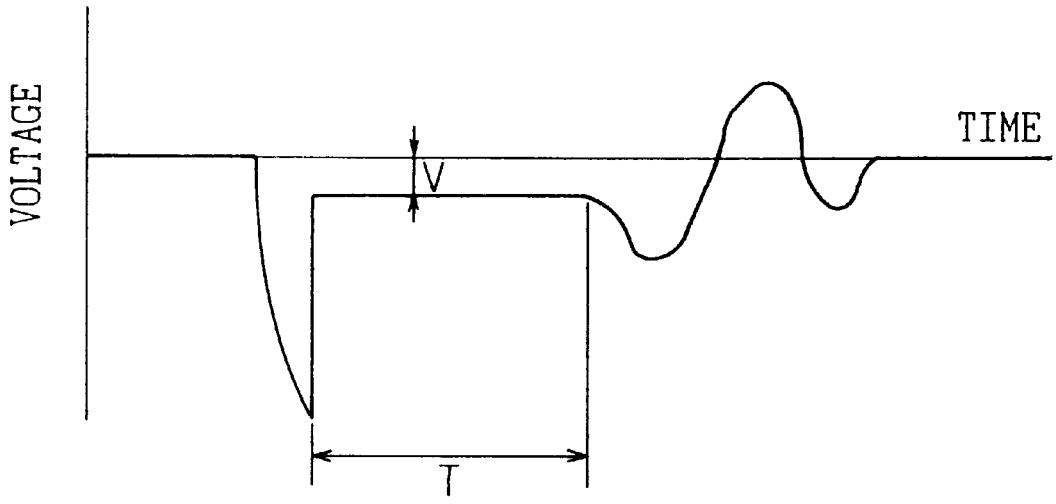
FIG. 6A is a graph showing the voltage waveform at normal times.
Figure 6B:
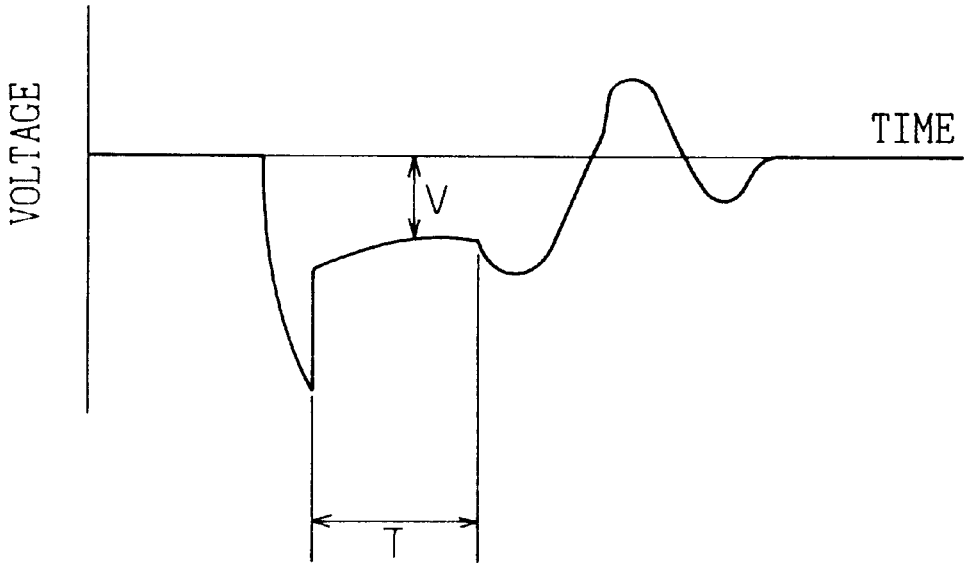
FIG. 6B is a graph showing the voltage waveform during occurrence of side sparks.

The side sparks were judged by oscilloscope observation of the voltage waveform applied to the spark plug during discharge. Specifically, the voltage waveform shown in FIG. 6A represents normal discharge with no side sparks, while the voltage waveform shown in FIG. 6B is a particular waveform in which side sparks occurred, wherein the discharge time T was short and the induction discharge voltage V was high.

Figure 5A:
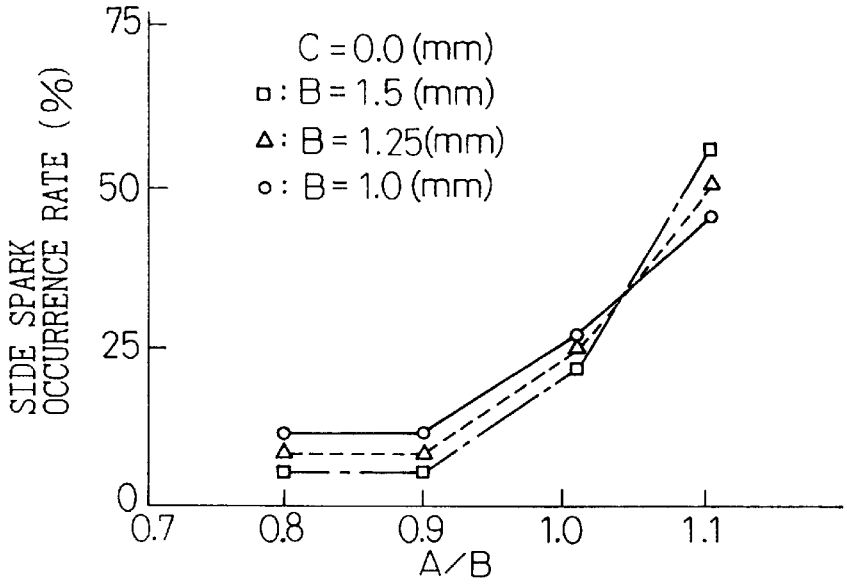
FIGS. 5A to 5C are graphs showing the occurrence rate of side sparks.
Figure 5B:
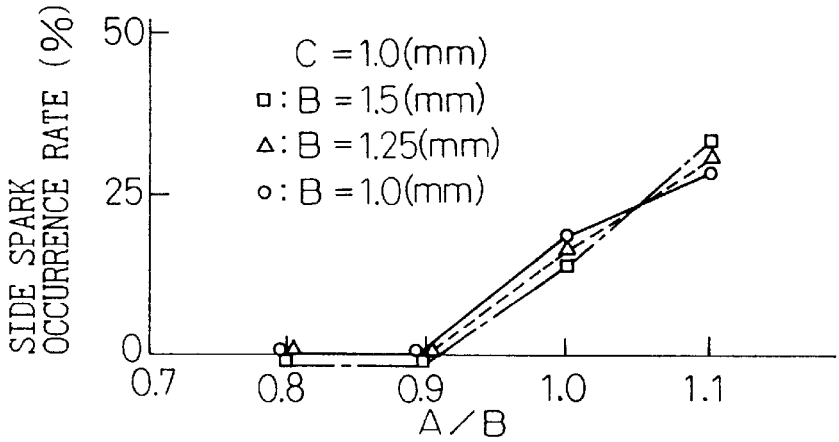
Figure 5C:
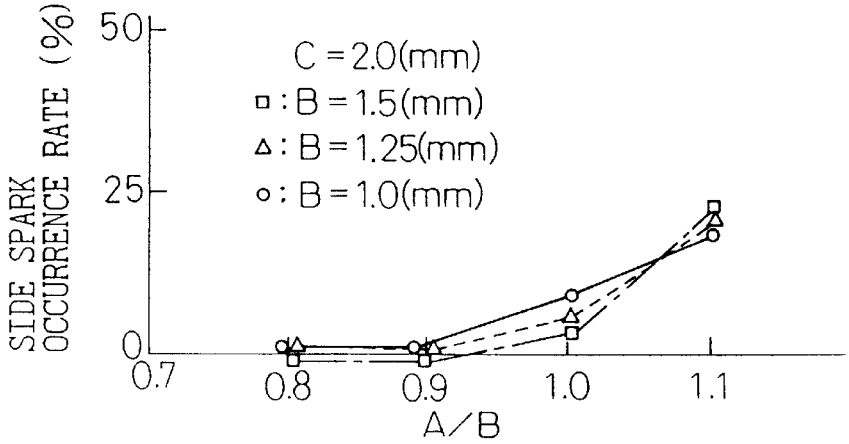

When the voltage waveform shown in FIG. 5B was observed even once during a single racing, this was recorded as a racing with side sparks, and the proportion of the number of racings in which side sparks occurred out of 50 racings was calculated as the side spark occurrence rate (%), which is shown in FIGS. 5A–5C.

As is confirmed by the results in FIGS. 5A–5C, when A/B is greater than 0.9, that is, when the gas volume 7 width B is smaller than A×(10/9), the side spark occurrence rate increases dramatically. It is also shown that when the protruding length C is 1.0 mm or greater, the side spark occurrence rate is 0, and thus absolutely no side sparks are generated. In other words, it was confirmed that when $B \leqq A \times (10/9)$ (mm) and $1.0 \leqq C$ (mm)

in this embodiment, the occurrence of side sparks may be effectively prevented.

The following is comparative data for side spark occurrence rates in small-sized spark plugs with a platinum electrode and an iridium electrode.

The spark plugs, engines, etc. used for this comparative experiment were the same as for the evaluation of the tendency for side sparks to occur in the spark plugs described previously (FIGS. 5A–5C), except that in this case C=1.0 mm, B=1.0 mm and A/B=1.0. In addition, for comparison the side spark occurrence rate was also determined for cases where the tip of the tip section 3*b* of the center electrode 3 was Ir and Pt, respectively.

Figure 7:
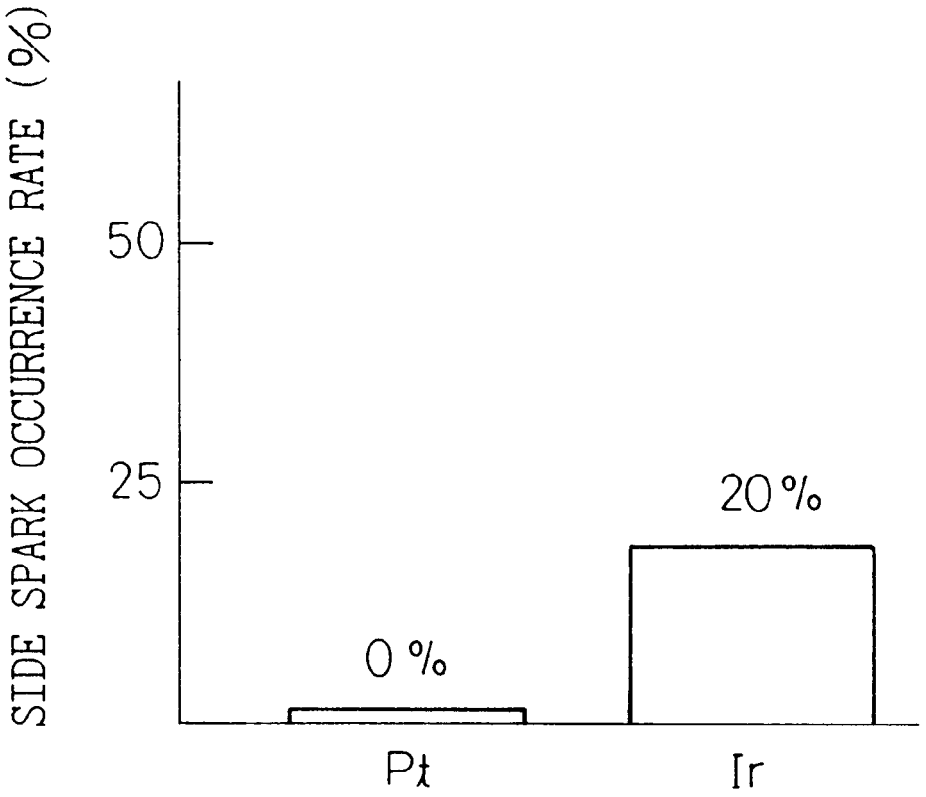
FIG. 7 shows the occurrence of side sparks with an end tip made of Pt and one made of Ir.

The results are shown in FIG. 7. This bar graph clearly shows that no side sparks occurred in the case of Pt, whereas the side sparks were considerable in the case of Ir, although the other conditions were identical.

The results of evaluating the wear resistance of spark plugs of the invention will now be discussed with reference to FIG. 8.

The experimental spark plugs 1–4 used for this evaluation were such as shown in FIG. 3, wherein the plug screw outer diameter D was 12 mm, the protruding height H of the noble metal tip 51 with respect to the center electrode 3 was 0.8 mm, the discharge gap A was 1.1 mm, gas volume 7 width B was 1.7 mm, the protruding length C of the insulator 2 with respect to the fitting piece 1 was 2.0 mm, the tip diameter E of the insulator 2 was 4.6 mm and the diameter F of the center electrode 3 near the tip section 2*b* of the insulator 2 was 2.5 mm.

The other noble metal tip 52 was made of Pt-20Ir-2Ni, the tip diameter was 0.9 mm, the height was 0.3 mm, the height I of the cylinder section 3*c* of the center electrode 3 was 1.0 mm, and the diameter J was 1.5 mm. The material and end diameter G of the noble metal tip 51 were both varied during the evaluation.

Specifically, experimental spark plug 1 had a noble metal tip 51 made of pure Ir and an end diameter G of 0.6 mm, experimental spark plug 2 had a noble metal tip 51 made of Ir-10 wt % Rh and an end diameter G of 0.6 mm, experimental spark plug 3 had a noble metal tip 51 made of Ir-10 wt % $Y_2O_3$ and an end diameter G of 0.6 mm, and experimental spark plug 4 had a noble metal tip 51 made of pure Ir and an end diameter G of 0.9 mm.

A conventional spark plug was also used which was the same type as described previously.

The evaluation of the wear resistance was conducted by measuring the amount of wear of the noble metal tip 51 and the noble metal tip 52 after 500 hours of discharge under conditions of 60 ignitions per minute using a power source with a discharge energy of 55 mJ. More specifically, the pre-discharge gap A (mm) and the post-discharge gap A (mm) were measured, and the difference was recorded as the amount of wear (mm) of the noble metal tip 51 and the noble metal tip 52 as shown in FIG. 6.

Figure 8:
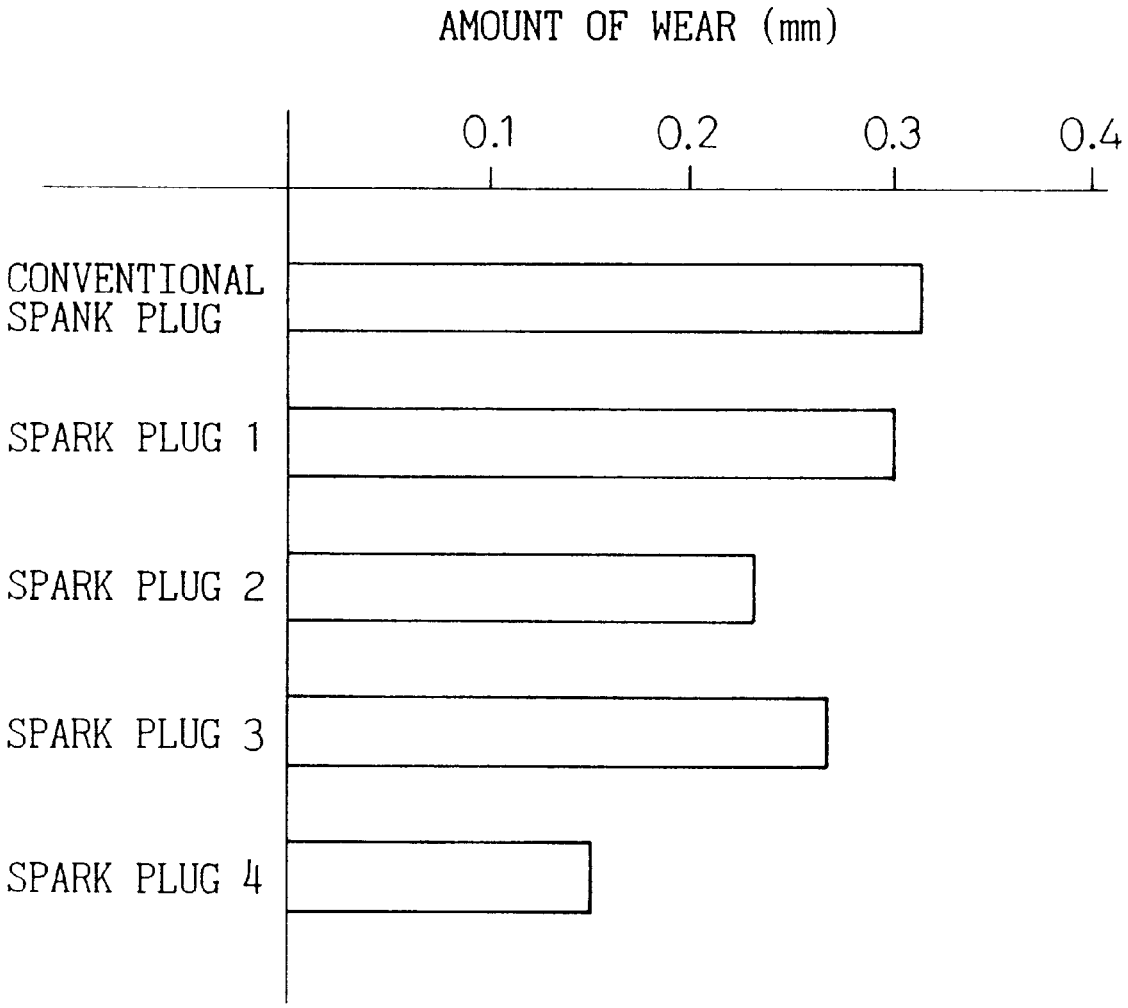
FIG. 8 is a graph showing evaluation of wear resistance.

As seen by the results in FIG. 8, all of the experimental spark plugs 1 to 4 had the same or less wear of the noble metal tip 51 compared to the comparative example, though having a smaller end diameter G of the noble metal tip 51 than conventional spark plugs. In other words, it was confirmed that greater wear resistance than conventional spark plugs may be achieved by using a noble metal tip 51 made of Ir or an Ir alloy similar to experimental spark plugs 1 to 4.

It has also been confirmed that spark plugs having noble metal tips made of Ir alloys other than those used in experimental spark plugs 1 to 4, for example, Ir alloys containing Ir with one or more noble metals selected from among Pt, Pd and Ru, or Ir alloys containing pure Ir or one of the above-mentioned Ir alloys combined with one or more selected from among Ni, W, Si and $ZrO_2$, have equal or superior wear resistance compared to conventional spark plugs.

In the embodiments described above, the noble metal tip 51 and the noble metal tip 52 were formed on the center electrode 3 and grounding electrode 4, respectively, but the present invention is not limited to this construction, and for example, the noble metal tip 51 alone may be formed on the center electrode 3.

What is claimed is:

1. A spark plug comprising:

a center electrode made of a Ni alloy material with a tip section;

an insulator which covers the periphery of said center electrode so that said tip section of said center electrode is exposed, said insulator also having a tip section;

a fitting piece which surrounds the periphery of said insulator and forms a plug screw on the outer side, with a gas volume being formed between said fitting piece and said insulator, and said tip section of said insulator being exposed;

a noble metal tip made of Ir or Ir alloy material and containing at least 60% iridium provided on said tip section of said center electrode, wherein the entire exposed surface of said noble metal tip that protrudes from said center electrode is made of said Ir or Ir alloy material; and a grounding electrode anchored to said fitting piece and separated by a discharge gap from and opposite said noble metal tip, wherein 0.9 mm≦A≦1.35 mm, (10/9) A≦B, 1.0 mm≦C≦2.5 mm, 10 mm≦D≦12 mm, 0.6 mm≦G≦0.9 mm, and 0.3 mm≦H≦1.0 mm, where A is the length of said discharge gap, B is the width of said gas volume, C is the protruding length of said insulator with respect to said fitting piece, D is the outer diameter of said plug screw section of said fitting piece, G is the diameter of the end of said noble metal tip, and H is a height of the exposed surface of said noble metal tip in the direction of the axis thereof.

2. The spark plug according to claim 1, wherein said noble metal tip is made of a material consisting of Ir combined with one or more noble metals selected from Pt, Pd, Rh and Ru.

3. The spark plug according to claim 1, wherein said noble metal tip is made of a material consisting of a combination of one or more selected from Ni, W, Si, $Y_2O_3$ and $ZrO_2$ with a material made of Ir or Ir combined with one or more noble metals selected from Pt, Pd, Rh and Ru.

4. The spark plug according to claim 1, wherein 2.0 mm≦F≦2.7 mm, where F is the diameter of said center electrode.

* * * * *